United States Patent [19]

Ueyama et al.

[11] Patent Number: 4,840,835

[45] Date of Patent: Jun. 20, 1989

[54] HEAT-SENSITIVE TRANSFERRING RECORDING MEDIUM

[75] Inventors: Seiji Ueyama, Hirakata; Hiroyasu Onoe, Ikoma, both of Japan

[73] Assignee: General Company Limited, Japan

[21] Appl. No.: 759,859

[22] Filed: Jul. 29, 1985

[30] Foreign Application Priority Data

Mar. 12, 1985 [JP] Japan ..... 60-47441

[51] Int. Cl.[4] ..... B41M 5/26

[52] U.S. Cl. ..... 428/212; 428/195; 428/207; 428/484; 428/488.4; 428/913; 428/914

[58] Field of Search ..... 106/31; 428/212, 195, 428/207, 484, 488.1, 488.4, 913, 914

[56] References Cited

U.S. PATENT DOCUMENTS 3,418,148 12/1968 Barz ..... 428/488.1

FOREIGN PATENT DOCUMENTS 217392 12/1983 Japan ..... 428/488.1

224392 12/1984 Japan ..... 428/488.4

*Primary Examiner*—Ellis P. Robinson

*Assistant Examiner*—P. R. Schwartz

*Attorney, Agent, or Firm*—Wegner & Bretschneider

[57] ABSTRACT

A heat-sensitive transferring recording medium is composed of a substrate, a heat-sensitive releasing layer and a heat-sensitive transferring ink layer laminated in the mentioned order.

6 Claims, No Drawings

HEAT-SENSITIVE TRANSFERRING RECORDING MEDIUM

BACKGROUND OF THE INVENTION

1. Field of the Invention

This invention realtes to a heat-sensitive transferring recording medium used for heat-sensitive transferring recording apparatuses such as thermal facsimile, thermal printer and the like.

2. Description of the Prior Art

Heat-sensitive recording system which is of non-impact type has recently drawn attention since the system is free of noise and can be easily handled.

Indeed, conventional heat-sensitive recording systems are free of noise and neither development nor fixation of the images is necessary and, in addition, the handling is easy, but the resulting record is liable to be falsified and its durability is not so good.

For the purpose of solving these drawbacks, a particular heat-sensitive transferring recording method was proposed. That is, a heat melting ink layer is provided on a substrate, and said ink layer contacted with a receiving paper (recording paper) followed by heating with a thermal head through the substrate to melt said ink layer resulting in transferring of the heated portion to a receiving paper which is an ordinary paper.

The above-mentioned heat-sensitive transferring recording method can give good printed letters where the smoothness of the receiving paper which is an ordinary paper is high, but where the smoothness is low, for example, the Bekk smoothness test value is not higher than 50 sec., the heat melting ink layer contacts the receiving paper at some portions while said layer does not contact the receiving paper at other portions, because of the uneven surface of the receiving paper. This results in a low transferring efficiency, formation of void, and low sharpness. In addition, since the heat melting ink has a high fluidity, the ink penetrates into the inside of the receiving paper so that the density of the printed letters is low and good printed letters can not be obtained.

SUMMARY OF THE INVENTION

An object of the present invention is to provide a heat-sensitive transferring recording medium free of the above-mentioned drawbacks.

Another object of the present invention is to provide a heat-sensitive transferring recording medium having a high transferring efficiency and capable of producing printed images free of void.

A further object of the present invention is to provide a heat-sensitive transferring recording medium whose ink penetrates little into a receiving paper resulting in forming printed images of high density.

Still another object of the present invention is to provide a heat-sensitive transferring recording medium capable of producing a clear recording of high density and free of void with a high transferring efficiency.

According to the present invention, there is provided a heat-sensitive transferring recording medium which comprises a substrate, a heat-sensitive releasing layer overlying the substrate, and a heat-sensitive transferring ink layer overlying the heat-sensitive releasing layer.

DESCRIPTION OF THE PREFERRED EMBODIMENTS

In order to obtain printed letters of high density and little void on a paper of low smoothness, it is necessary to make the transferring layer in a form of block and use a heat-sensitive transferring ink layer of high melt viscosity so as to decrease penetration of the ink into the paper. That is, the transferring is not effected in a form of point, but in a form of plane.

Further, it is necessary to facilitate releasing of the heat-sensitive transferring ink layer from the substrate and enhance the transferring efficiency.

In case that a heat-sensitive transferring ink layer has a high melt viscosity and is directly contacted with a substrate, releasing of the heat-sensitive transferring ink layer is liable to become difficult. Therefore, it is contemplated to make easy firstly the releasing of the heat-sensitive transferring ink layer from the substrate by means of the heat-sensitive releasing layer and then make higher the melt viscosity of the heat-sensitive transferring ink layer so as to decrease penetration of the ink into paper and effecting the transferring of ink in a form of block.

The heat-sensitive transferring recording medium comprises a substrate, a heat-sensitive releasing layer and a heat-sensitive transferring ink layer.

The substrate may be composed of a plastic film provided with a heat resistant protective layer.

The heat-sensitive releasing layer is preferably a layer which can be easily melted when heated and has a low melt viscosity. The heat-sensitive transferring ink layer is preferably a layer which becomes cohesive when heated, and has a melt viscosity higher than that of the heat-sensitive releasing layer.

The heat-sensitive releasing layer comprises, for example, 50–100 parts by weight of wax, 0–30 parts by weight of binder, and 0–50 parts by weight of coloring agent and pigment.

The heat-sensitive transferring ink layer comprises, for example, 0–50 parts by weight of wax, 30–80 parts by weight of binder and 5–50 parts by weight of coloring agent and pigment.

The thickness of the heat-sensitive releasing layer is preferably 1–4$\mu$ and that of the heatsensitive transferring ink layer is preferably 2–8$\mu$.

The substrate in the present invention includes a thin paper of, for example, less than 20$\mu$ Thick, such as glassine paper, condenser paper and the like, and a heat resistant film of, for example, less than 10$\mu$ thick, such as polyester, polyimide, nylon, polypropylene and the like.

Binders, waxes, and coloring agents which may be used in the present invention are exemplified in Table 1 below.

TABLE 1

| | |
|---|---|
| Wax | Paraffine wax |
| | Microcrystalline wax |
| | Carnauba wax |
| | Shellac wax |
| | Montan wax |
| | Higher fatty acids |
| | Higher fatty acid amides |
| | Higher alcohols |
| | Metallic soap |
| Binder | Polyvinyl acetate |
| | Polyvinyl chloride |
| | Polyvinyl butyral |
| | Polyethylene |

TABLE 1-continued

| | |
|---|---|
| | Polyamide<br>Hydroxyethylcellulose<br>Methylcellulose<br>Nitrocellulose<br>Polystyrene<br>Polyesters<br>Polyacrylate<br>Vinyl chloride-vinyl acetate copolymer<br>Ethylene-vinyl acetate copolymer<br>Ethylene-organic acid copolymer<br>Vinyl chloride-vinylidene chloride copolymer |
| Coloring agent and pigment | Coloring pigments such as carbon black, iron oxide, Prussian blue, titanium oxide, lake red, and the like;<br>Dyes such as basic dyes, neozapon dyes and the like;<br>Extender pigments such as calcium carbonate, clay, talc and the like |

As materials for the heat resistant protective layer, there may be mentioned higher fatty acids, fluorocarbon polymers, and silicone resins.

The heat-sensitive transferring recording medium can be produced, for example, by the following procedure.

A coating composition for a heat-sensitive releasing layer and a coating composition for a heatsensitive transferring ink layer are dispersedly mixed by heated ball mills or attritors, or are dispersed in solvents or water, and then they are successively applied to a substrate by a hot melt coater, a solvent coater or an aqueous coater.

When a heat resistant protective layer is formed in a substrate, the above-mentioned material for the heat resistant protective layer may be dispersed in and mixed with a solvent and, before the heat-sensitive releasing layer and the heat-sensitive transferring ink layer are formed, the resulting coating material is applied by a solvent coater to a surface of the substrate opposite to the surface to which the above-mentioned layers are to be formed.

The heat-sensitive transferring recording medium of the present invention has two layers, that is, a layer facilitating to release the ink layer (heatsensitive releasing layer) on a substrate and a layer having cohesion and capable of cohering to receiving paper (heat-sensitive transferring ink layer) on the heat-sensitive releasing layer, and therefore, when heated by using a thermal head, the heat-sensitive transferring ink layer is released from the substrate and completely transferred to a receiving layer due to the cohesion of the heat-sensitive transferring ink layer to receiving paper. As a result, the transferring efficiency is enhanced and printed letters free of void can be produced.

Since viscosity of the heat-sensitive transferring ink layer is high, penetration of the ink into receiving paper is little and printed letters of high density can be obtained. Even if a receiving paper of less smoothness is used, the heat-sensitive transferring recording medium can give a clear record of high density and free of void at a high transferring efficiency.

The following examples are given for illustrating the present invention more in detail. Parts and % are by weight. Reference Example Paraffine wax: 40 parts
Carnauba wax: 30"
Ethylene-vinyl acetate (90:10) Copolymer: 10"
Carbon black: 20"

An ink composed of the above-mentioned components was applied to a polyester film of 6μ thick in the thickness of 4μ by a hot melt coating method.

EXAMPLE 1

Paraffin wax was applied to a polyester film of 6μ thick in the thickness of 1μ by a hot melt coating method to form a heat-sensitive releasing layer.

Ethylene-vinyl acetate (90:10) copolymer: 70 parts
Carnauba wax: 10 parts
Carbon black: 20"
Ethyl acetate: 100"
Toluene: 200"

To the surface of the heat-sensitive releasing layer was applied a composition composed of the abovementioned components by a mayer bar method, followed by drying to form a heat-sensitive transferring ink layer.

EXAMPLE 2

Paraffin wax: 70 parts
Ethylene-vinyl acetate (90:10) copolymer: 10 parts
Carbon black: 20 parts A composition composed of the above-mentioned components was applied to a polyester film of 6μ thick in the thickness of 2μ by a hot melt coating method to form a heat-sensitive releasing layer.

To the surface of the heat-sensitive releasing layer was applied a composition composed of the following components by a mayer bar method and dried to form a heat-sensitive transferring ink layer of 3μ thick.

| | Component (parts) | Solid matter (%) |
|---|---|---|
| Ethylene-vinyl acetate (90:10) emulsion (solid matter 45%) | 160 | (68.6) |
| Carnauba emulsion (solid matter 30%) | 50 | (14.3) |
| Carbon black dispersion (solid matter 30%) | 60 | (17) |

Test Method

The heat-sensitive transferring recording mediums were tested by means of a heat-sensitive printer (cycle, 1.2 msec.; applied pulse width, 0.9 msec.; power, 0.5 W/dot) with a receiving paper (Bekk test, 16 sec.; Hammer Mill Bond paper) (JIS P8119).

The heat-sensitive transferring recording medium prepared in Reference Example gave many voids and low density while that prepared in each of Examples 1 and 2 gave good printed letters of few voids and high density.

What is claimed is:

1. A heat-sensitive transferring recording medium which comprises a substrate, a heat-sensitive releasing layer overlying the substrate, and a heat-sensitive transferring ink layer overlying the heat-sensitive releasing layer, wherein the heatsensitive releasing layer is easily melted when heated and the heat-sensitive transferring ink layer becomes cohesive when heated and has a melt viscosity that is higher than that of the heat-sensitive releasing layer.

2. A heat-sensitive transferring recording medium according to claim 1, in which the substrate is composed of a plastic film provided with a heat resistant protective layer.

3. A heat-sensitive transferring recording medium according to claim 2 in which the heat-sensitive releasing layer comprises a ratio of wax : resin : coloring agent of 50–100:0–30:0–50 (parts by weight) and the heat-sensitive transferring ink layer comprises a ratio of wax : resin : coloring agent of 0–50:30–80:5–50 (parts by weight).

4. A heat-sensitive transferring recording medium according to claim 3 wherein the coloring agent is a dye or pigment.

5. A heat-sensitive transferring recording medium according to claim 1, in which the heat-sensitive releasing layer comprises a ratio of wax : resin : coloring agent of 50–100:0–30:0–50 (parts by weight) and the heat-sensitive transferring ink layer comprises a ratio of wax : resin : coloring agent of 0–50:30–80:5–50 (parts by weight).

6. A heat-sensitive transferring recording medium according to claim 5 wherein the coloring agent is a dye or pigment.

* * * * *